US005469905A

United States Patent [19]

McKinney et al.

[11] Patent Number: 5,469,905

[45] Date of Patent: Nov. 28, 1995

[54] SECURITY AND HURRICANE SHUTTER

[75] Inventors: Roy L. McKinney, Coconut Grove; Abraham Wien, Miami, both of Fla.

[73] Assignee: Fold-A-Shield, Coral Gables, Fla.

[21] Appl. No.: 117,827

[22] Filed: Sep. 7, 1993

[51] Int. Cl.[6] ..... E05D 15/26

[52] U.S. Cl. ..... 160/35; 160/183

[58] Field of Search ..... 160/35, 84.1 A, 160/84.1 E, 183, 194, 207, 199, 188

[56] References Cited

U.S. PATENT DOCUMENTS

| | | | |
|---|---|---|---|
| 2,423,987 | 7/1947 | Levikow | 160/35 |
| 3,738,413 | 6/1973 | Frobosilo et al. | 160/35 |
| 3,842,891 | 10/1974 | Kinnroth et al. | 160/35 |
| 4,460,030 | 7/1984 | Tsunemura et al. | 160/35 |
| 4,503,900 | 3/1985 | Osaka et al. | 160/172 R |
| 4,763,713 | 8/1988 | Kraus | 160/84.1 E |
| 4,917,167 | 4/1990 | Voss et al. | 160/84.1 A |
| 4,998,576 | 3/1991 | Moreno | 160/84.1 A X |
| 5,097,883 | 3/1992 | Robinson et al. | 160/183 |
| 5,139,075 | 8/1992 | Desrochers | 160/265 X |

*Primary Examiner*—David M. Purol

*Attorney, Agent, or Firm*—Caesar, Rivise, Bernstein, Cohen & Pokotilow, Ltd.

[57] ABSTRACT

A security and hurricane shutter of greater strength and stability than available shutters using blades which are longitudinally pivoted to each other. The angle between adjacent blades is adjustable to provide for greater strength and stability at smaller angles, i.e., more blades per linear foot of the shutter, at smaller angles, and larger angles using fewer blades per linear foot for shutters, such as smaller width shutters which would require fewer blades per linear foot. The shutter can use either pulleys or direct mechanical drive mechanisms. The pulley systems or direct mechanical drive mechanisms can be powered by an installed electrical motor, a portable motor, or a hand crank for shutters of smaller size or to back up the installed electrical motor in case of power failure or motor failure.

23 Claims, 12 Drawing Sheets

28
29
14
24
26
18
6
16
20
18
22
12
11
24
47
44
45
42
38
42
44
18
20
16
6
16
32
10
49
30
46
24
25
26

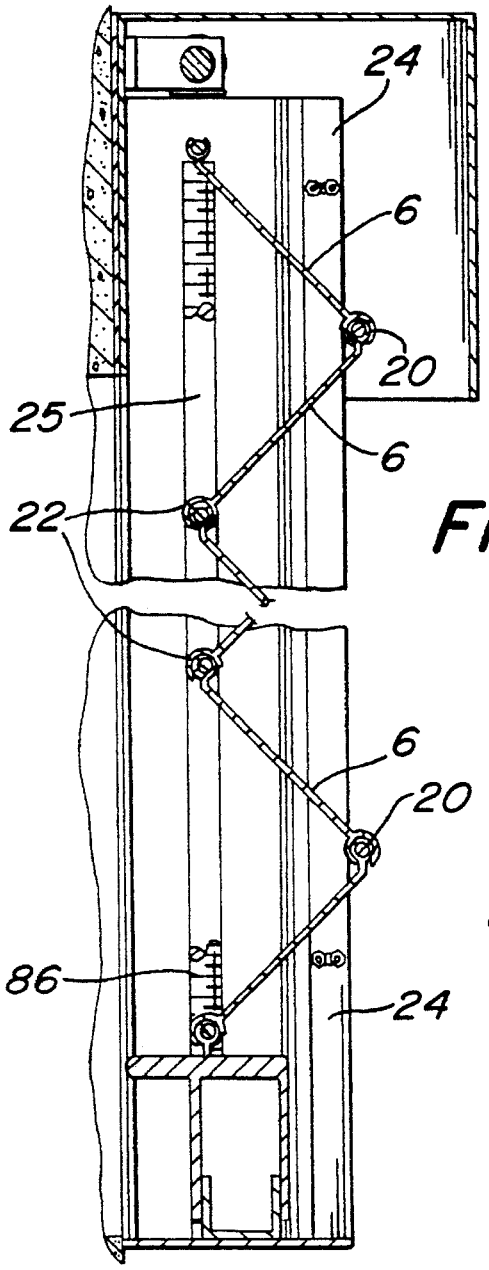
FIG. 12
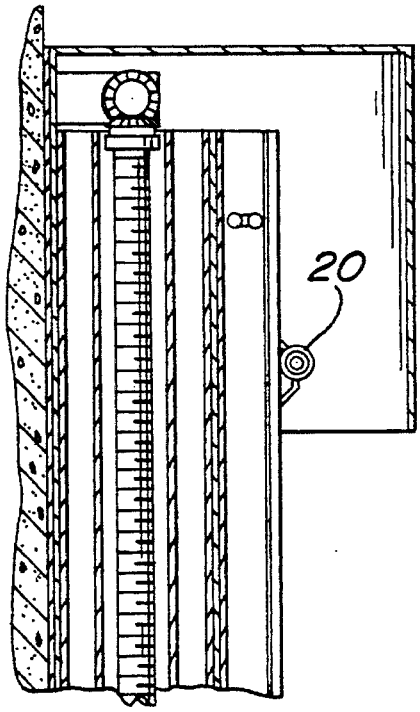
FIG. 13
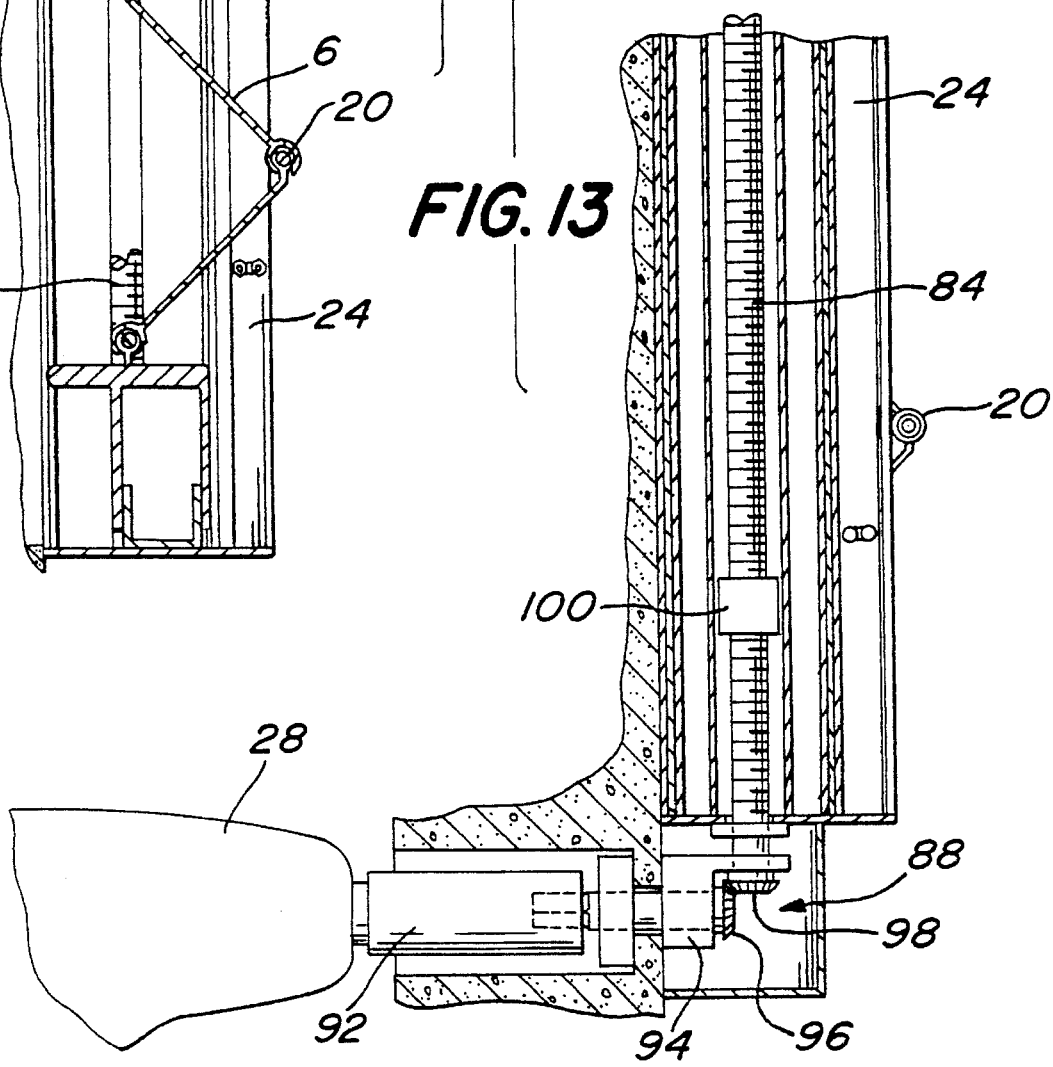

FIG. 15
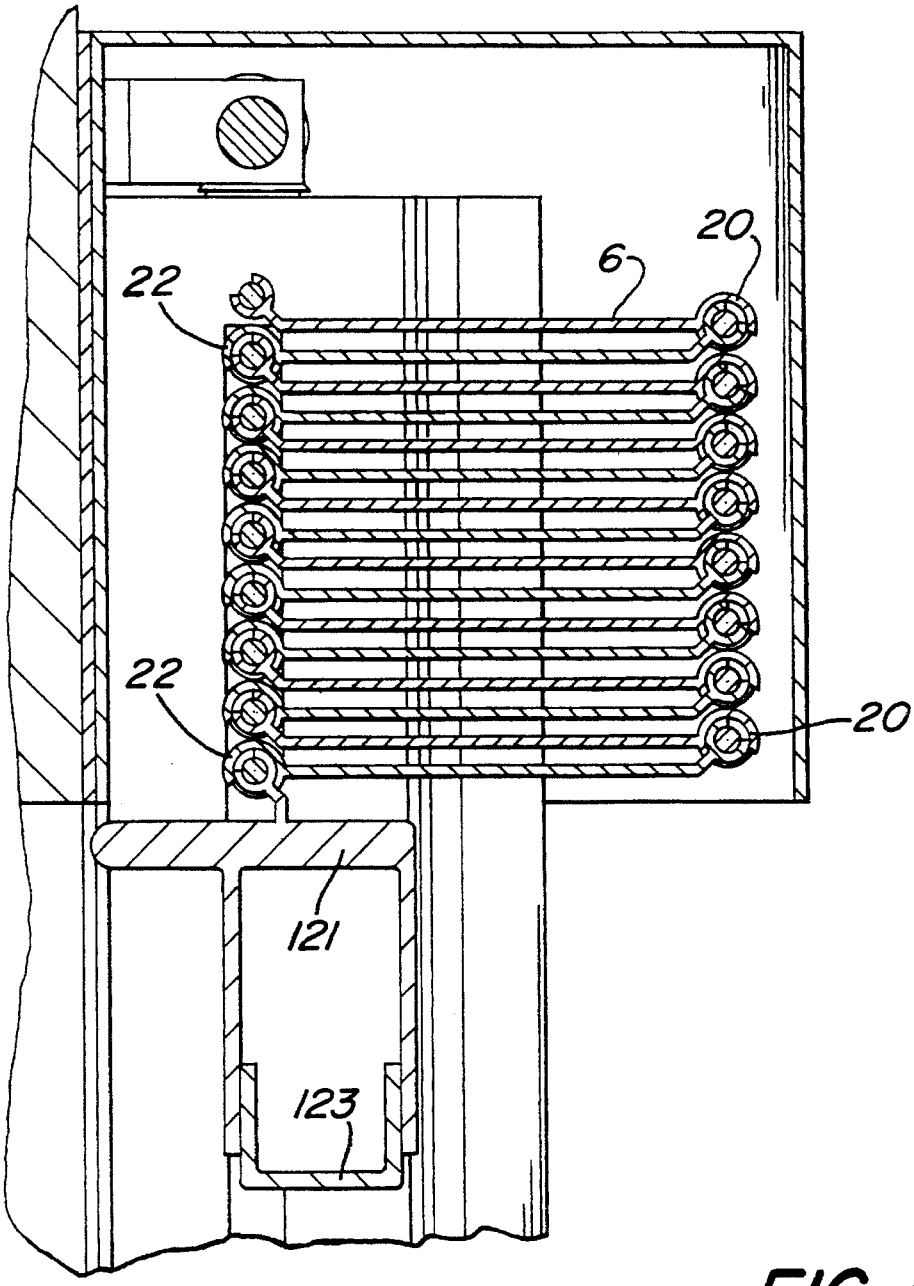
FIG. 16
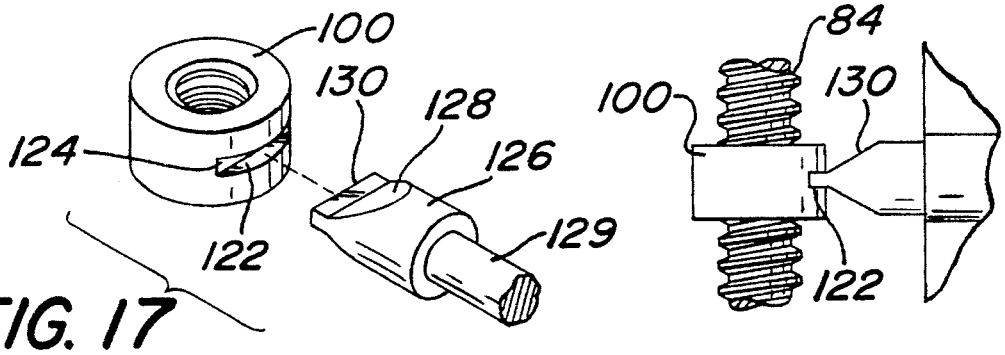
FIG. 17

SECURITY AND HURRICANE SHUTTER

BACKGROUND OF THE INVENTION

This invention relates generally to security and hurricane shutters, and more particularly to a security and hurricane shutter with a means for adjusting the angle between adjoining blades to vary the strength of the shutter against impact.

In recent years, coastal areas of the United States have been subjected to hurricane storms of increasing intensity. On Aug. 17, 1992, Hurricane Andrew, one of the most severe storms ever recorded on the Eastern and Gulf Coasts of the United States, struck Southern Florida. The damage to commercial, industrial and residential structures was extensive with upwards of 250,000 people made homeless. In the wake of this storm, regulatory agencies in Florida have increased the required strength of security and hurricane shutters to withstand high winds and impact of debris and other flying objects caused by hurricanes. It will now be required that all newly installed security and hurricane shutters be capable of withstanding winds of up to 200 miles per hour and up to 2 successive impacts of a 2×4 beam weighing 8 lbs. and traveling at 55 miles per hour.

Existing vertical and horizontal shutters which have blades, which are positioned to form an essentially flat surface in their operating position, do not have the strength to withstand the high winds and impacts which occur during severe hurricane storms such as Hurricane Andrew. In addition, existing vertical shutters are the roll-up type which require large enclosure boxes, and which are extended by gravity feed which can cause problems in case of jams.

There is a need, therefore, for a shutter which has the stability and strength to withstand higher wind velocities and higher impacts than is presently available with existing shutters.

OBJECTS OF THE INVENTION

Accordingly, it is the general object of the instant invention to provide a security and hurricane shutter which overcomes the limitations of existing shutters.

It is a further object of the instant invention to provide a security and hurricane shutter which has greater strength and stability than existing shutters.

It is yet a further object of the instant invention to provide a security and hurricane shutter wherein the angle between the blades of the shutter can be set to a predetermined angle.

It is still yet a further object of the instant invention to provide a security and hurricane shutter with a means for varying the strength of the shutter against high winds and impact from flying objects.

It is another object of the instant invention to provide a security and hurricane shutter with an enclosure box for holding the shutter blades in the raised position which is smaller than existing enclosure boxes.

It is still another object of the instant invention to provide a security and hurricane shutter with an operating mechanism which can be motor driven or cranked by hand.

It is still yet another object of the instant invention to provide a security and hurricane shutter which may be operated by an installed motor or which may be coupled to a portable motor.

It is an additional object of the instant invention to provide a vertical security and hurricane shutter which uses pulleys and cables to raise and lower the blades of the shutter.

It is yet an additional object of the instant invention to provide a vertical security and hurricane shutter with a mechanical drive system for raising or lowering the shutter.

It is still yet an additional object of the instant invention to provide a horizontal security and hurricane shutter with blades that are vertically disposed, with greater strength than existing vertically disposed blade shutters.

It is a further additional object of the instant invention to provide a horizontal security and hurricane shutter with vertically disposed blades which has a direct mechanical drive system for opening and closing the shutter.

SUMMARY OF THE INVENTION

These and other objects of the instant invention are achieved by providing a security and hurricane shutter with blades that are pivotably connected to each other in accordion style. The strength of the shutter against high winds and impact can be varied by adjustably setting the angle between the blades at their junction. Thus, the smaller the angle between the blades, the greater the number of blades per linear foot and therefore, the greater the strength and stability of the shutter.

In the open or raised position for horizontally disposed blades, the blades fold compactly against each other. Therefore, the enclosure box which holds the blades when the shutter is not extended is compact and considerably smaller than the enclosure box required for existing roll-up types of shutters.

For smaller shutters, up to 16 square feet, pulleys are employed to raise and lower the shutter. For larger shutters, up to 20 feet or greater in width, a direct mechanical drive system using universal gearing is used. Either installed motors or portable motors can be used to operate the shutters with pulley systems or mechanical drive systems.

Another embodiment of the invention is for a security and hurricane shutter having vertically disposed blades which are angled with respect to each other in the closed position. These may either use pulley drive systems or direct mechanical drive systems.

Finally, for shutters which are small in dimension, a hand crank may be supplied to raise and lower vertical shutters or to open and close horizontal shutters.

DESCRIPTION OF THE DRAWING

Other objects and many of the intended advantages of this invention will be readily appreciated when the same becomes better understood by reference to the following detailed description, when considered in connection with the accompanying drawing wherein:

FIG. 12 is a sectional view of the shutter taken along the line 12—12 of FIG. 11;

FIG. 13 is a sectional view of the shutter taken along the line 13—13 of FIG. 11;

FIG. 15 is a sectional view of the upper portion of the shutter when the shutter is in the raised position;

FIG. 16 is an enlarged view showing the direct drive mechanism of the embodiment and its connection to the lowest blade of the shutter;

FIG. 17 is an enlarged view of the threaded nut which is threaded onto a shaft of the direct drive mechanism and the dowel which couples the lowest blade of the shutter to the threaded nut;

DETAILED DESCRIPTION OF THE PREFERRED EMBODIMENTS

Figure 1:
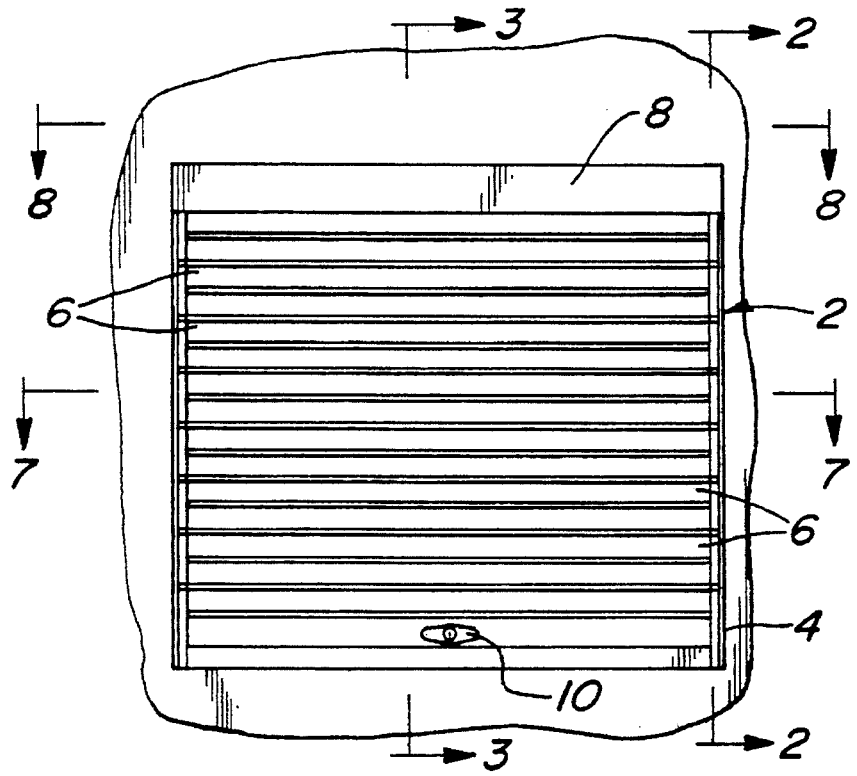
FIG. 1 is a frontal view of the vertical shutter of this invention with horizontally disposed blades.

Referring now in greater detail to the various figures of the drawing, wherein like reference characters refer to like parts, the security and hurricane shutter 2 of this invention is shown in FIG. 1. The shutter 2 is installed in the window jam 4 of a structure. The shutter 2 comprises a plurality of blades 6 which are interconnected longitudinally to form an accordion-like shutter, an enclosure box 8 which encloses the blades of the shutter 2 when the shutter is in its raised position and a locking mechanism 10.

Figure 2:
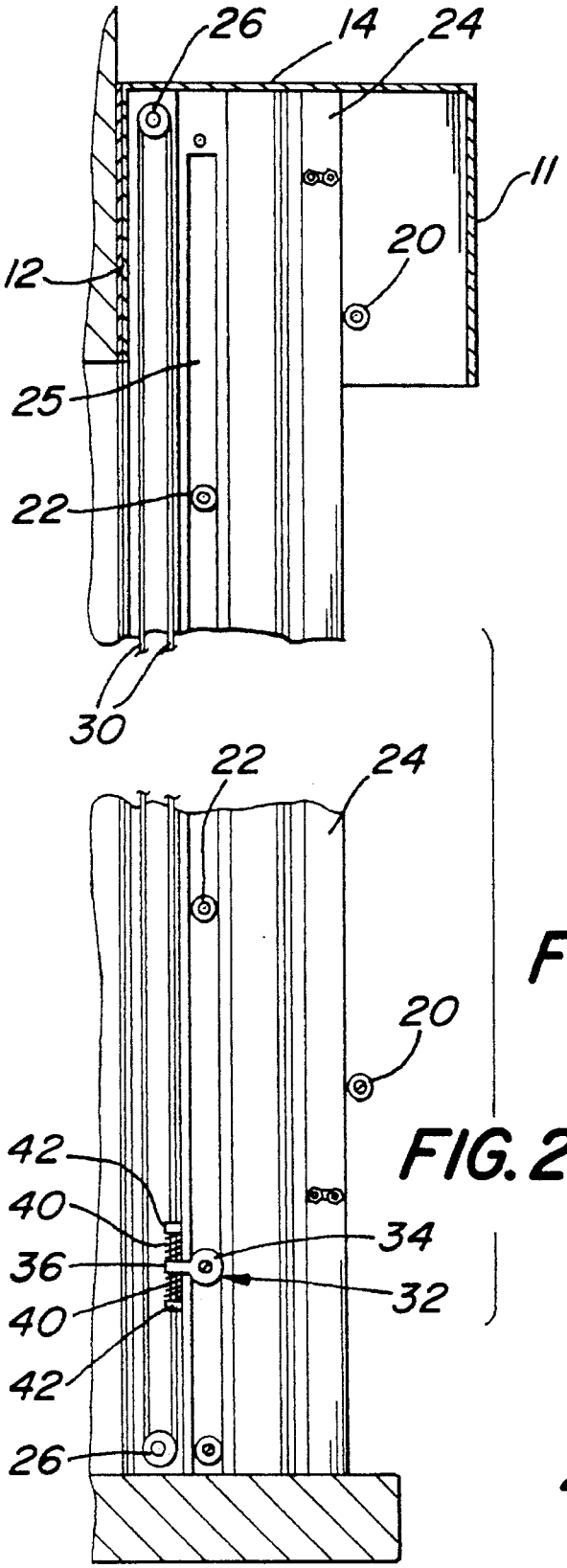
FIG. 2 is a sectional view of the shutter taken along the line 2—2 of FIG. 1.
Figure 3:
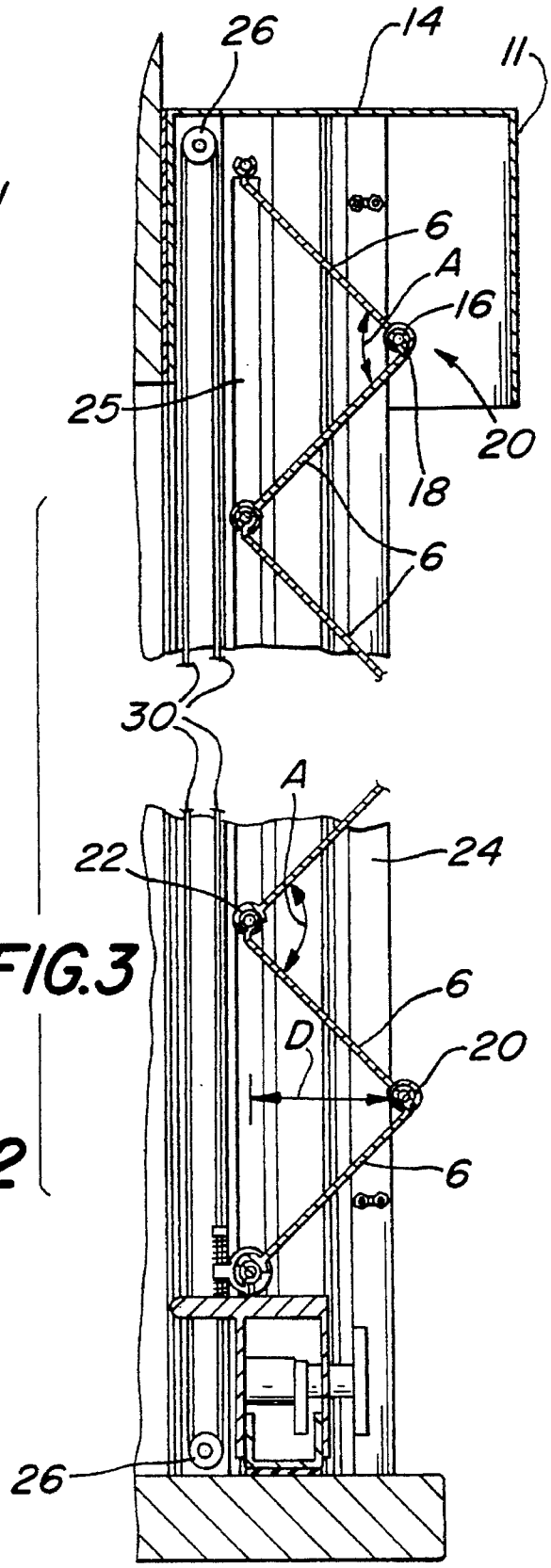
FIG. 3 is a sectional view of the shutter taken along the line 3—3 of FIG. 1.
Figure 4:
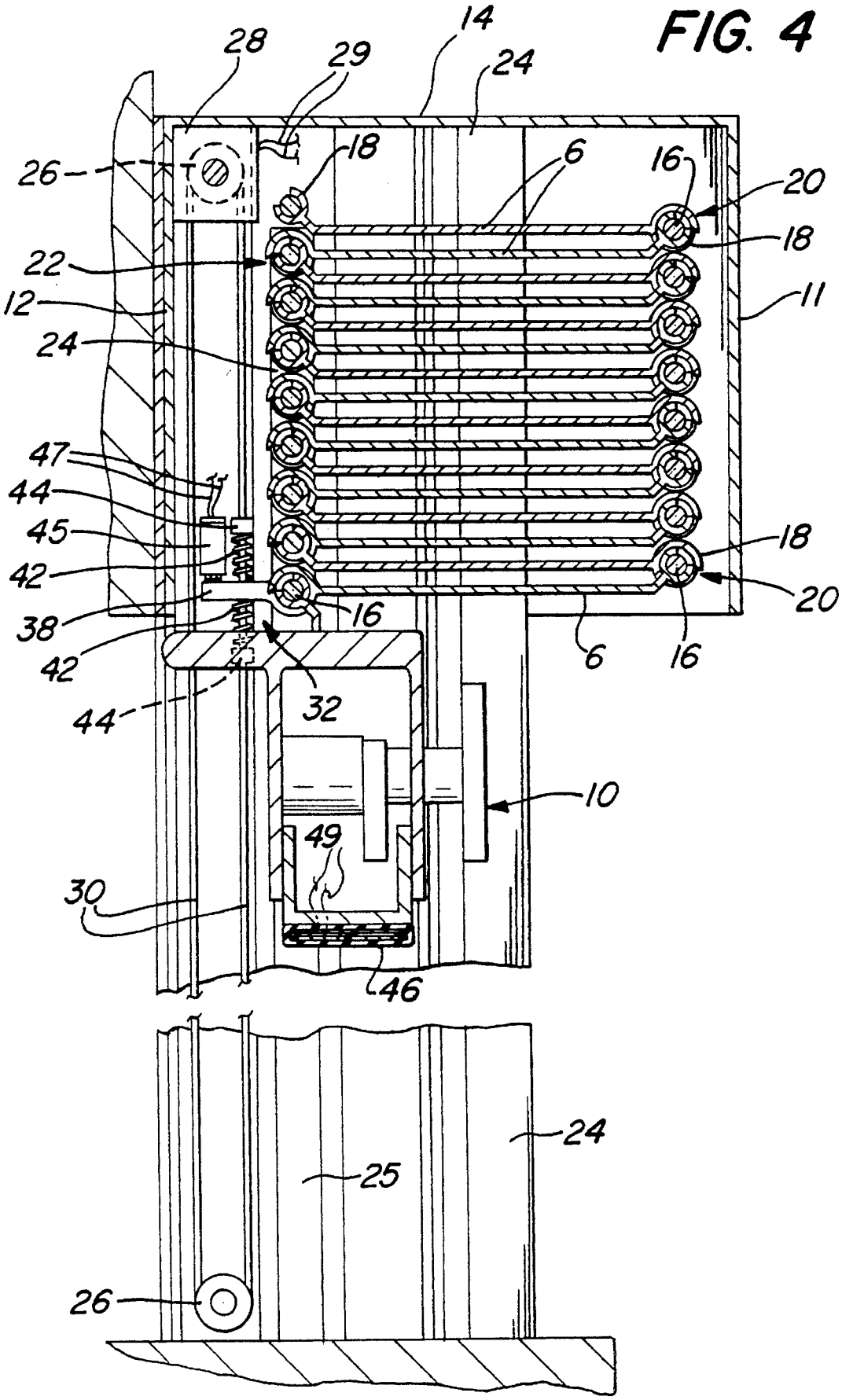
FIG. 4 is a side view, partially in section, of the shutter.

Referring now to FIGS. 2, 3 and 4, it is seen that the enclosure box 8 has a front wall 10, a rear wall 12 and a top wall 14. Each blade 6 has a circumferentially shaped longitudinal socket 16 attached to one longitudinal edge of the blade 6 and a rod 18 attached to the other longitudinal edge. At one longitudinal edge of the blade 6, an outer pivot 20 is formed with the cylindrically shaped socket of one blade enclosing the rod of its adjoining blade. Similarly, at the other end of each blade 6 an inner pivot 22 is formed, again with the cylindrically shaped longitudinal socket 16 of each blade 6 enclosing the rod 18 of its adjoining blade. Thus, as can be seen in FIG. 3, the last longitudinal edge of the uppermost blade 6 has a rod 18 attached thereto while the last longitudinal edge of the lowest blade 6 has a cylindrical socket 16 attached thereto. The shutter is formed by interconnecting the blades in alternating fashion at outer pivots 20 and inner pivots 22 to form an accordion-like structure.

As will be explained in detail below, the strength of the shutter can be varied by adjusting the distance D between the inner pivots 22 and outer pivots 20 which varies the angle A between the adjoining shutters.

Referring in particular to FIG. 4, the system for raising and lowering the shutter is shown. In the figure, the shutter is shown in its raised position with the blades 6 horizontally disposed in a closely packed parallel array. This method of stacking the blades of the shutter results in a considerable saving in the amount of space required for the shutter in its raised position and therefore results in an enclosure box of much smaller dimensions as compared to shutters which are of the roll-up type. In fact, in many cases, if the well of the window covered by the shutter is deep enough, the front wall 11 will not extend beyond the front wall of the structure. This results in less wind resistance and greater strength and stability during storms.

As the shutter is raised and lowered, the inner pivots 22 ride in a channel 25 while the outer pivots 20 are positioned by adjustable stop 24, as will be explained later. With the shutter fully retracted in the raised position, the blades 6, as mentioned previously, assume horizontal positions and the outer pivots 20 move away from the adjustable stop 24.

Figure 7:
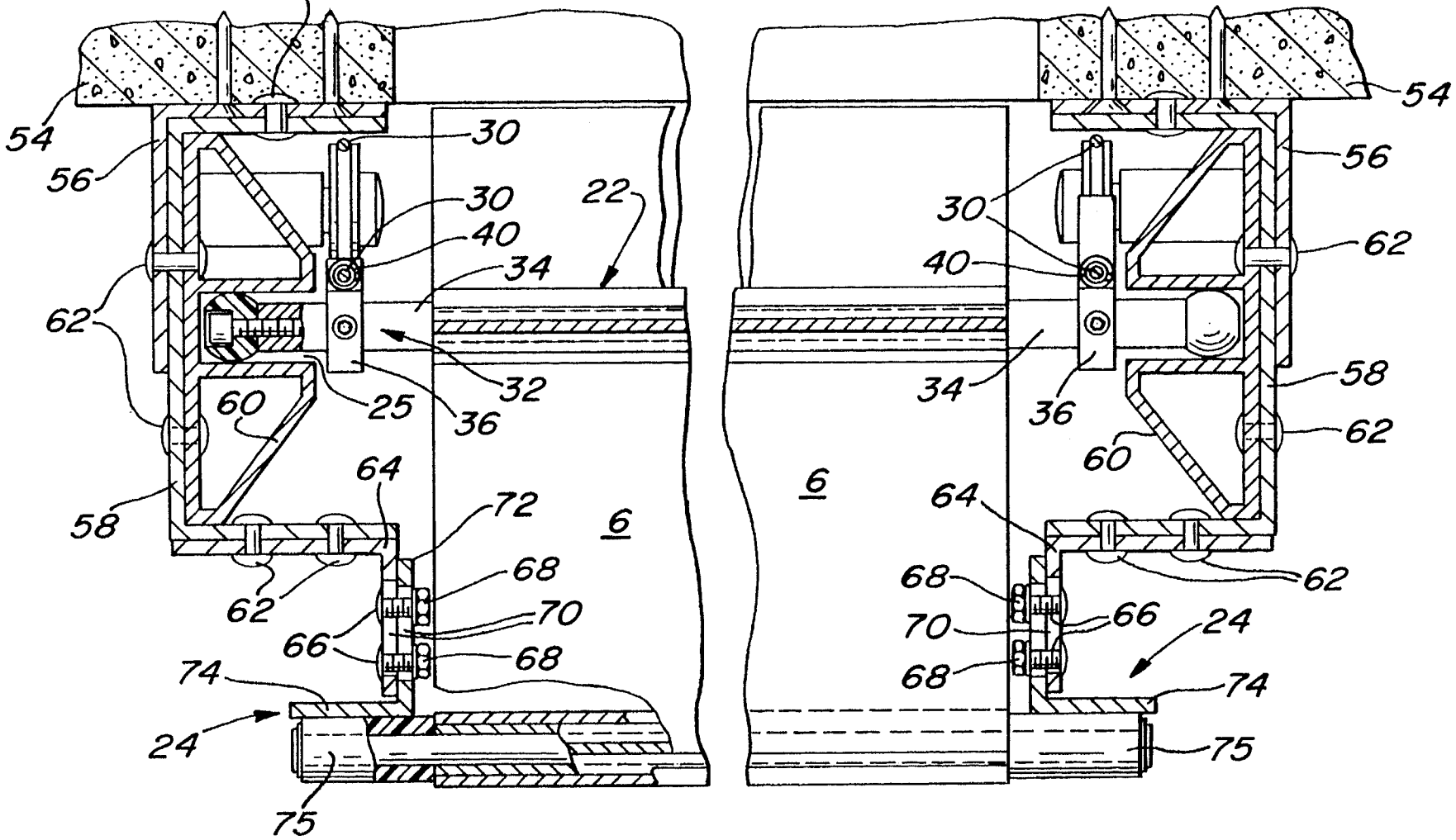
FIG. 7 is a sectional view of the shutter taken along the line 7—7 of FIG. 1.

The shutter 2 includes pulleys 26 at each end of the shutter which are rotated by a motor 28. Conductors 29 are connected to the motor to provide electrical power to the motor. The pulley 26 includes cables 30. As shown in FIG. 7, a connector 32 is attached to the lowest pivot 22. The connector 32 has a ring 36 and a flat portion 38. An extension 34 is placed at each end of the inner pivot 22 of the lowest shutter 6. The ring 36 is installed around the extension 34. The flat portion 38 has a hole 40 placed therein. One of the cables 30 is positioned through the hole 40 as shown in FIG. 7. Springs 42 (FIG. 4) are placed on opposite sides of the flat portion 38 between each side of the flat portion 38 and a stop 44. Thus, when the pulley is operated and the cable moved vertically, the shock due to abrupt stops or at the termination of the movement is taken up by the springs 42.

Also attached to the inner pivot 22 of the lowest blade 6 is the locking mechanism 10. Beneath the locking mechanism is a pressure pad 46 which automatically cuts off the motor when the shutter is lowered to its fully extended position, as will be explained in detail later. In addition, as can be seen in FIG. 4, a limit switch 45, with attached conductors 47, is operated by contact with the flat portion 38 of the connector 32 when the shutter is raised to its top position. Operation of the limit switch 45 will cut off the power to the motor. The direction of the motor 28 may be reversed automatically by relays operated by the limit switch, or two start buttons, one for each direction (not shown), as is the common practice.

Although, in this embodiment, the electrical motor is shown mounted within the enclosure box, the shutter can be raised and lowered by a motor which can be installed at other locations such as near the lower pulley 26. In addition, as is well known to those skilled in the art, if the electrical motor fails, a solenoid can be used to provide for the use of an external hand crank. Of course, with smaller shutters of lighter weight, the shutter can be installed without a motor and a hand crank provided only to operate the pulleys.

Figure 5:
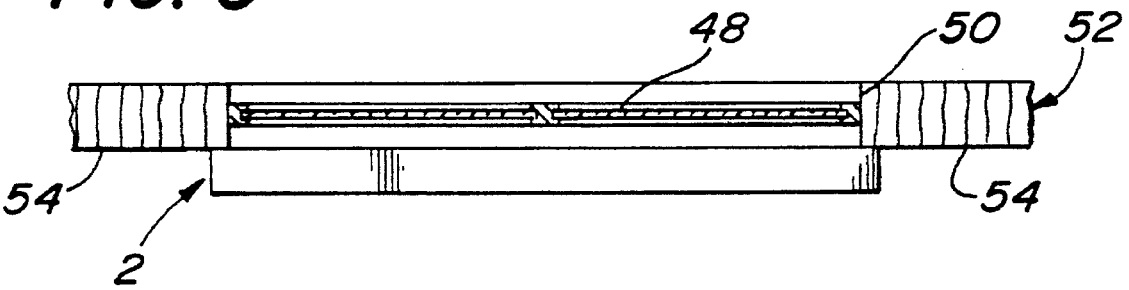
FIG. 5 is a top view of the shutter installed outside of a window frame of a structure.
Figure 6:
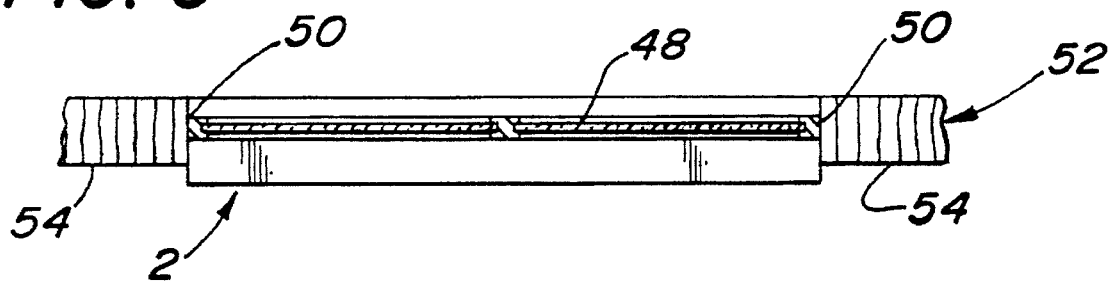
FIG. 6 is a top view of the shutter installed within a window frame of a structure.

Prior to explaining the operation of the adjustable stop, two basic modes of installation for the shutter 2 will be explained. As can be seen in FIG. 5, the window 48 is installed in window frame 50. The shutter 2 is installed on the outer wall 54 of the structure 52. FIG. 6 shows an alternative embodiment wherein the shutter 2 is installed within the window frame 50.

The operation of the adjustable stop 24 whose position varies the angle A between the blades 6 and therefore changes the strength of the blades, will now be explained. If the angle A between the blades is set at a low angle, there will be more blades of the shutter 2 per linear foot. On the other hand, if the angle between the blades is set at a greater value, there will be less blades 6 per linear foot of the shutter 2. The greater number of blades per linear foot results in greater strength against high wind velocities and flying debris. In the preferred embodiment, the angle between the blades can be varied between approximately 45° for higher strength to approximately 120° where lower strength is acceptable. In shutters which are wide, 20 feet or wider, the tendency of the shutter to buckle results in a requirement for a greater number of blades per foot and therefore a smaller angle between the blades for greater strength.

As can be seen in FIG. 7, an L-bracket 56 is attached to a U-shaped bracket 58 which is in turn attached to an interior bracket 60 to provide stability. The brackets 56, 58 and 60 are attached by rivets 62. Of course, other types of screws or bolts can be used. U-shaped bracket 58 has a horizontal segment 64.

Adjustable stop 24 is an L-shaped bracket having a horizontal segment 72 and a vertical segment 74. Segments 64 and 72 have elongated openings 70. Bolts 66 with nuts 68 are inserted through the elongated openings 70. Thus, it can be seen that the adjustable stop 24 may be moved closer or further from the inner pivots 22 and set at a position by tightening the bolts.

Attached to each end of the outer pivots 20 is an extension 75 which rides against the vertical segment 74 of the adjustable stop 24, as the shutter is raised and lowered.

Thus, it can be seen that, as the adjustable stop 24 is positioned closer to, or further from, the inner pivot 22, the outer pivot 20 moves away from, or closer to, the inner pivot 22.

Figure 7A:
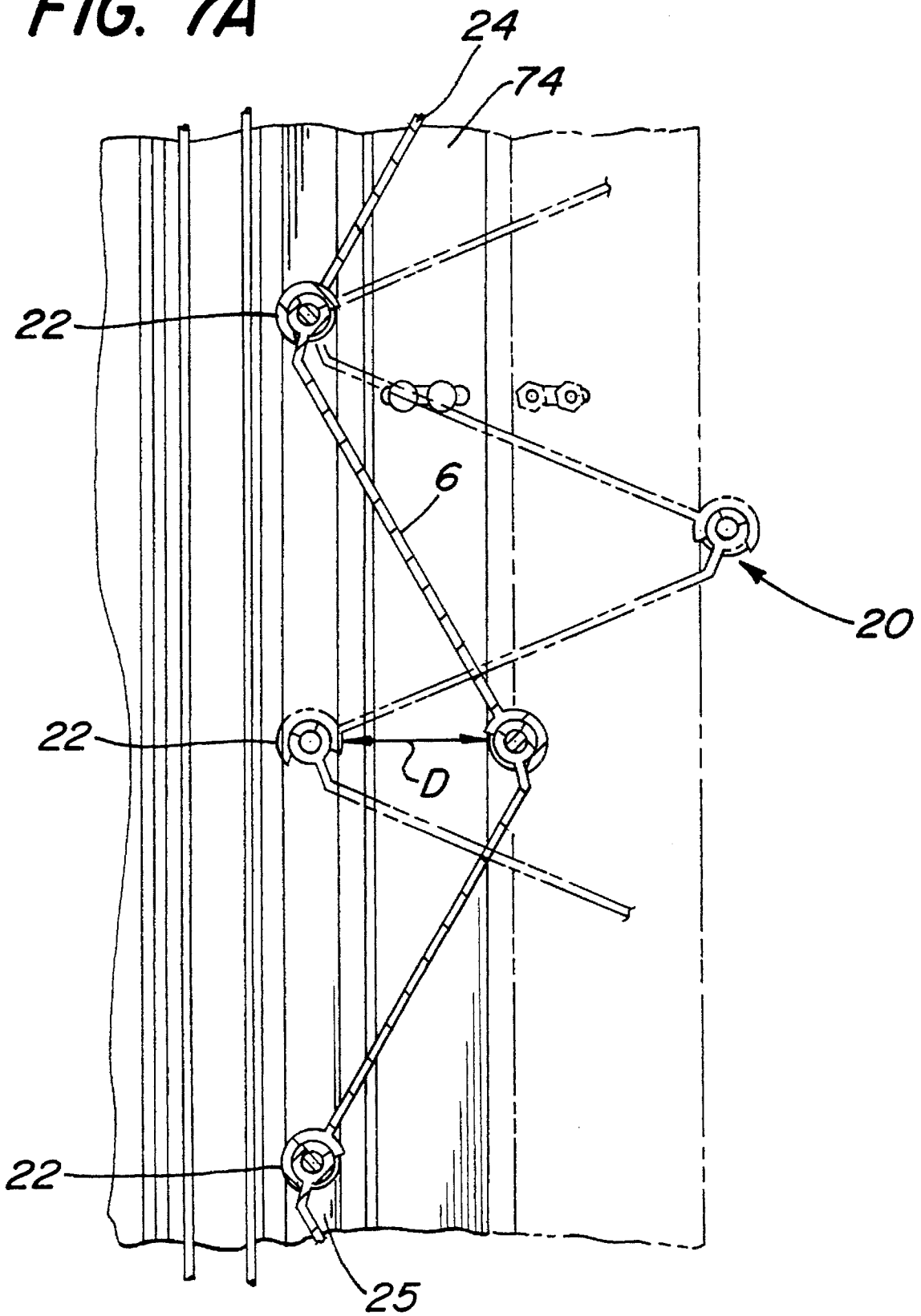
FIG. 7A shows the shutter with the angle between adjacent blades set at a wide angle and at a narrow angle (in phantom).

Referring now to FIG. 7A, there is shown two adjustments of the stop 24, one for a wide angle and the other for a narrow angle. Shown in solid lines are the blades 6 connected at a wide angle with the stop 24 adjusted to minimize the distance between the inner pivots 22 and the outer pivots 20. Shown in phantom are the blades 6 with a small angle between the blades obtained by setting the adjustable stop 24 to maximize the distance between the inner pivots 22 and the outer pivots 20. It should be noted, however, that the angles can be set to any value between the settings shown.

Figure 8:
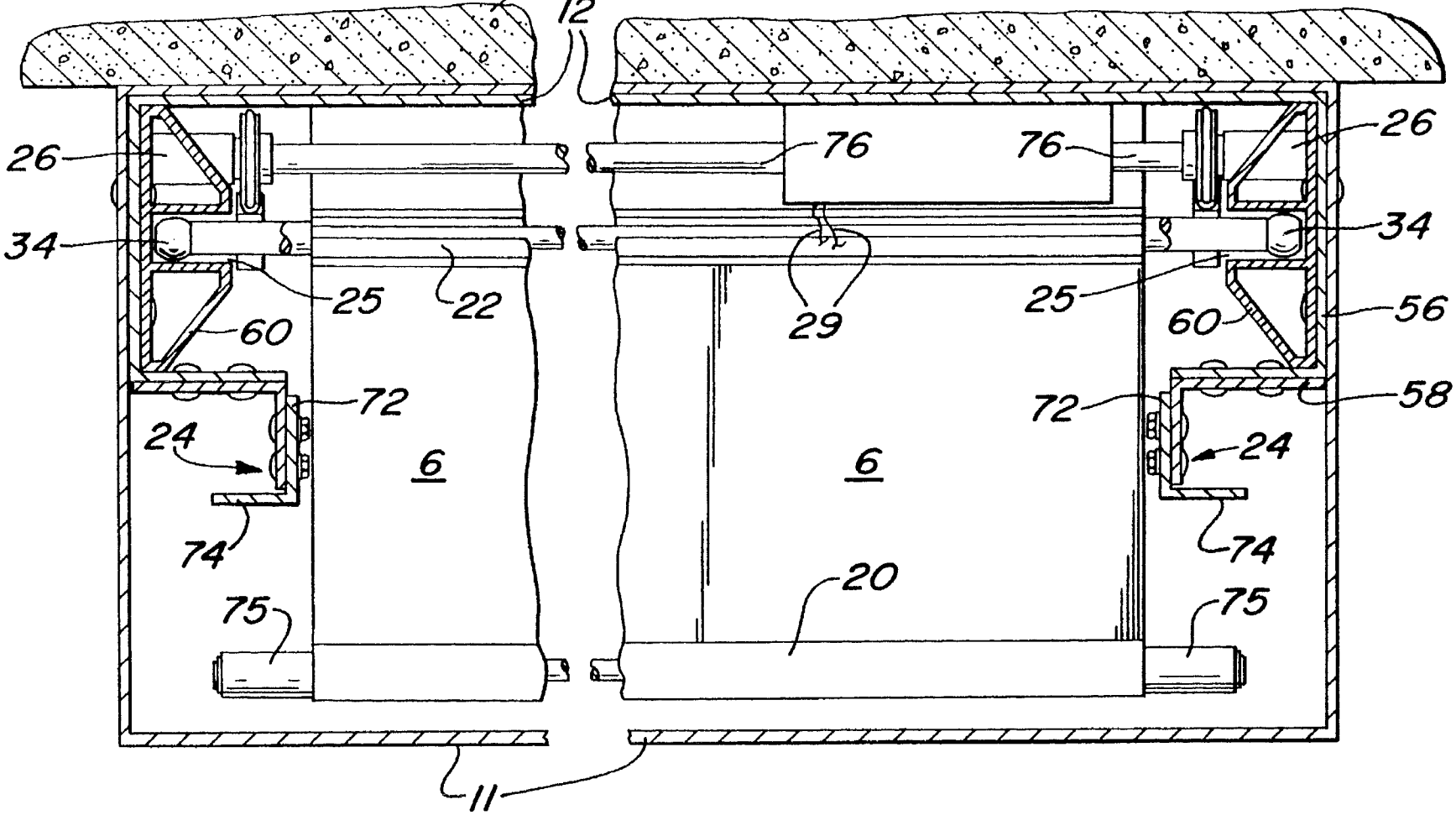
FIG. 8 is a top view of the shutter taken along the line 8—8 of FIG. 1.

FIG. 8 is a top sectional view of the shutter 2 showing the motor 28 connected to shafts 76 which enable the motor 28 to drive the pulleys 26 at both sides of the shutter 2.

Figure 9:
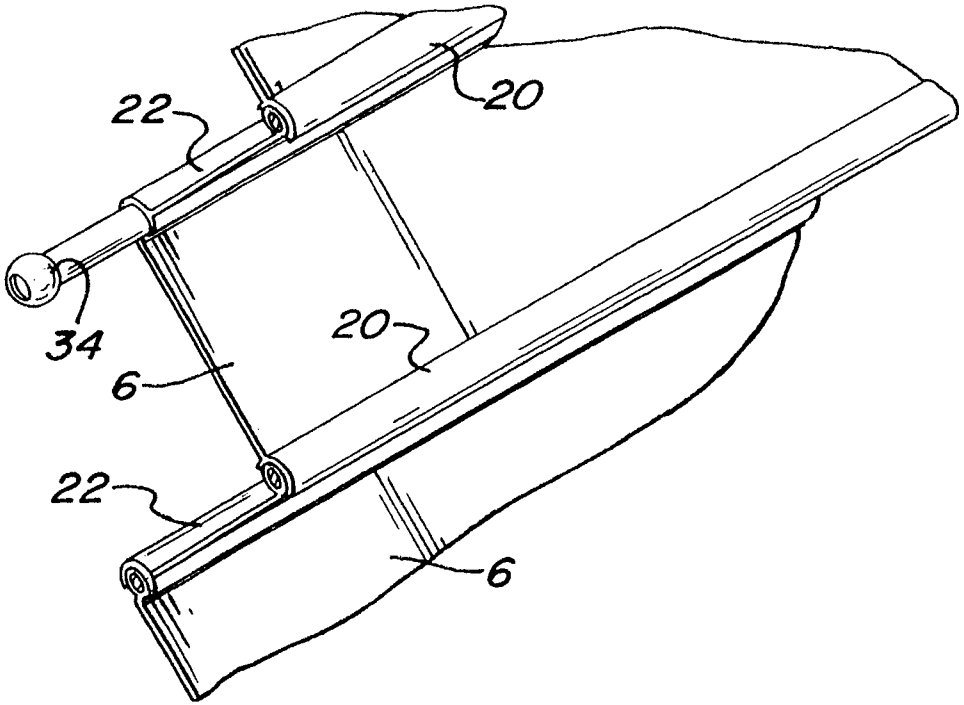
FIG. 9 is an enlarged isometric view of a portion of the shutter showing the coupling between the blades of the shutter.

FIG. 9 illustrates the accordion type of arrangement between the blades 6 showing the inner pivots 22 and the outer pivots 20. For the sake of clarity, only one extension 34 is shown with the other extension 34 and the extensions 75 connected to the inner pivots 20, not shown, in the interest of clarity.

Figure 10:
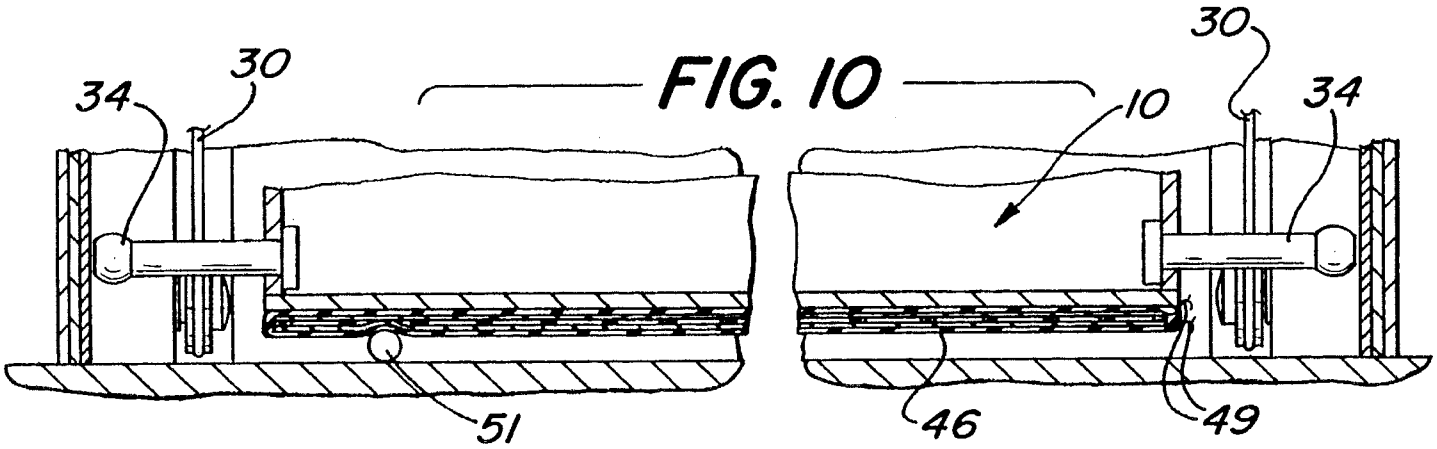
FIG. 10 is a sectional view of the bottom of the shutter showing the pressure pad which limits the motion of the shutter when it reaches its fully extended position.

FIG. 10 shows the operation of the pressure pad 46 when the shutter 2 is in its fully extended position. The pressure pad 46 is compressed against rod 51 which provides a conducting path between conductors 49 attached to the pressure pad 46 which then results in removal of power to the motor through the operation of a relay or solenoid (not shown). Of course, as stated previously, other types of limit switches or devices can be used to automatically stop the shutter at its limits of travel.

Figure 11:
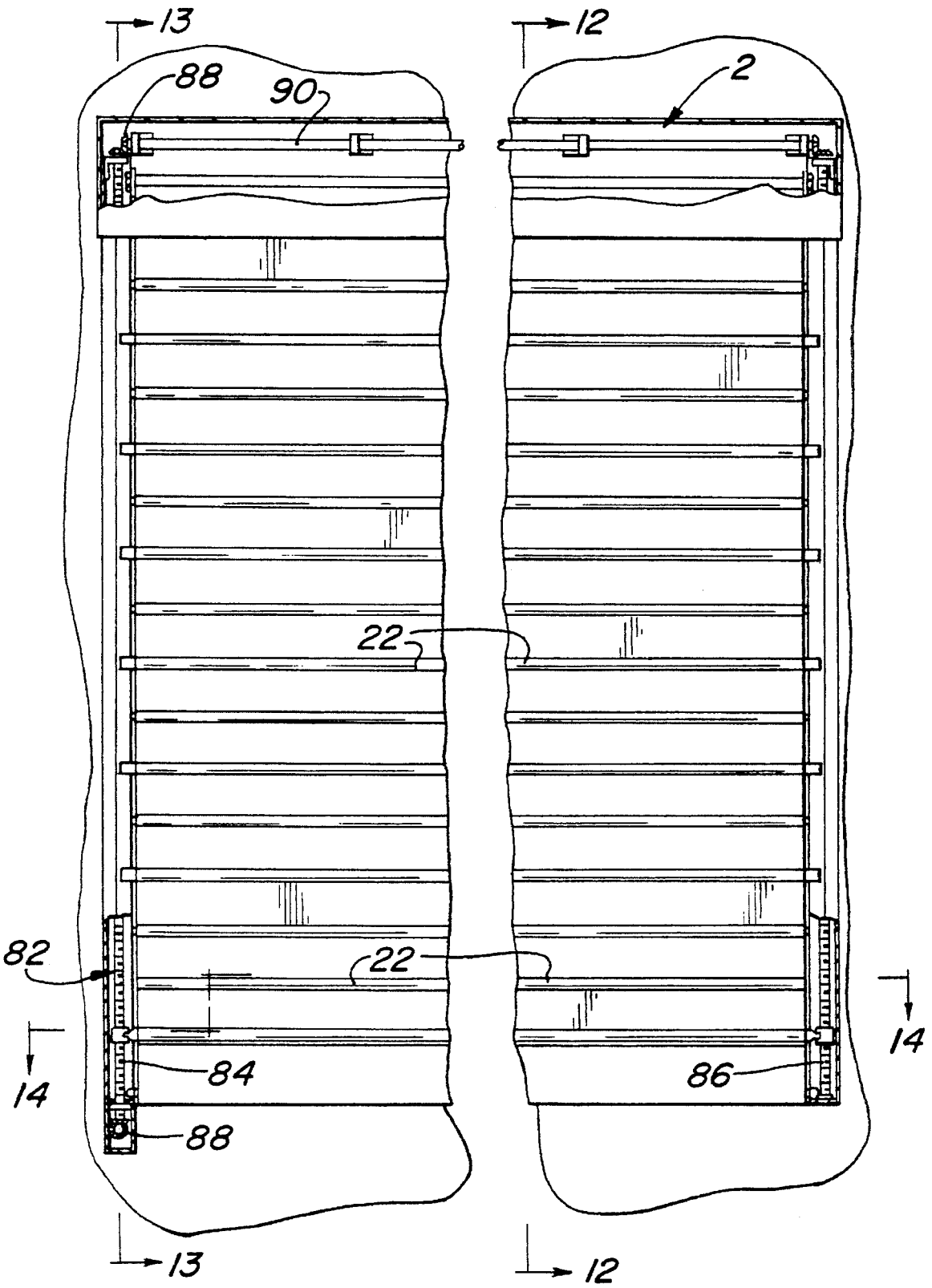
FIG. 11 shows another embodiment of the shutter partially in section which uses a direct drive mechanical system to raise and lower the shutter.

An alternative embodiment which uses a direct mechanical drive to raise or lower the shutter is shown in FIG. 11. The direct mechanical drive is used in cases of large heavy shutters to provide more positive drive than is available with pulleys. The direct mechanical drive eliminates the need for a locking mechanism because the shutter cannot be raised when it is at its fully lowered position without power applied to the drive. As can be seen in the figure, the direct mechanical drive system 82 comprises a left hand threaded shaft 84 and a right hand threaded shaft 86. Universal gears 88 provide power from a motor drive to the threaded shaft 84, then to transverse unthreaded shaft 90 and finally to left hand threaded shaft 86.

FIGS. 12 and 13 provide further detail regarding the drive system 82. As can be seen in FIG. 12, as in the previous embodiment using the pulleys, the inner pivots 22 ride in the channel 25 and the outer pivots 20 have extensions which abut and ride along the adjustable stop 24 as the shutter 2 is raised and lowered. FIG. 13 shows a portable motor 28 having a chuck 92 which is coupled to a shaft 94 of the drive gear teeth 96 of the universal gear 88. The driven gear teeth 98 rotate when the motor 28 is operated providing rotation to the threaded shaft 84 via universal gears 88. A threaded nut 100 rides up and down the threaded shaft 84 depending on whether the threaded shaft 84 rotates in a clockwise or counter-clockwise direction.

Figure 14:
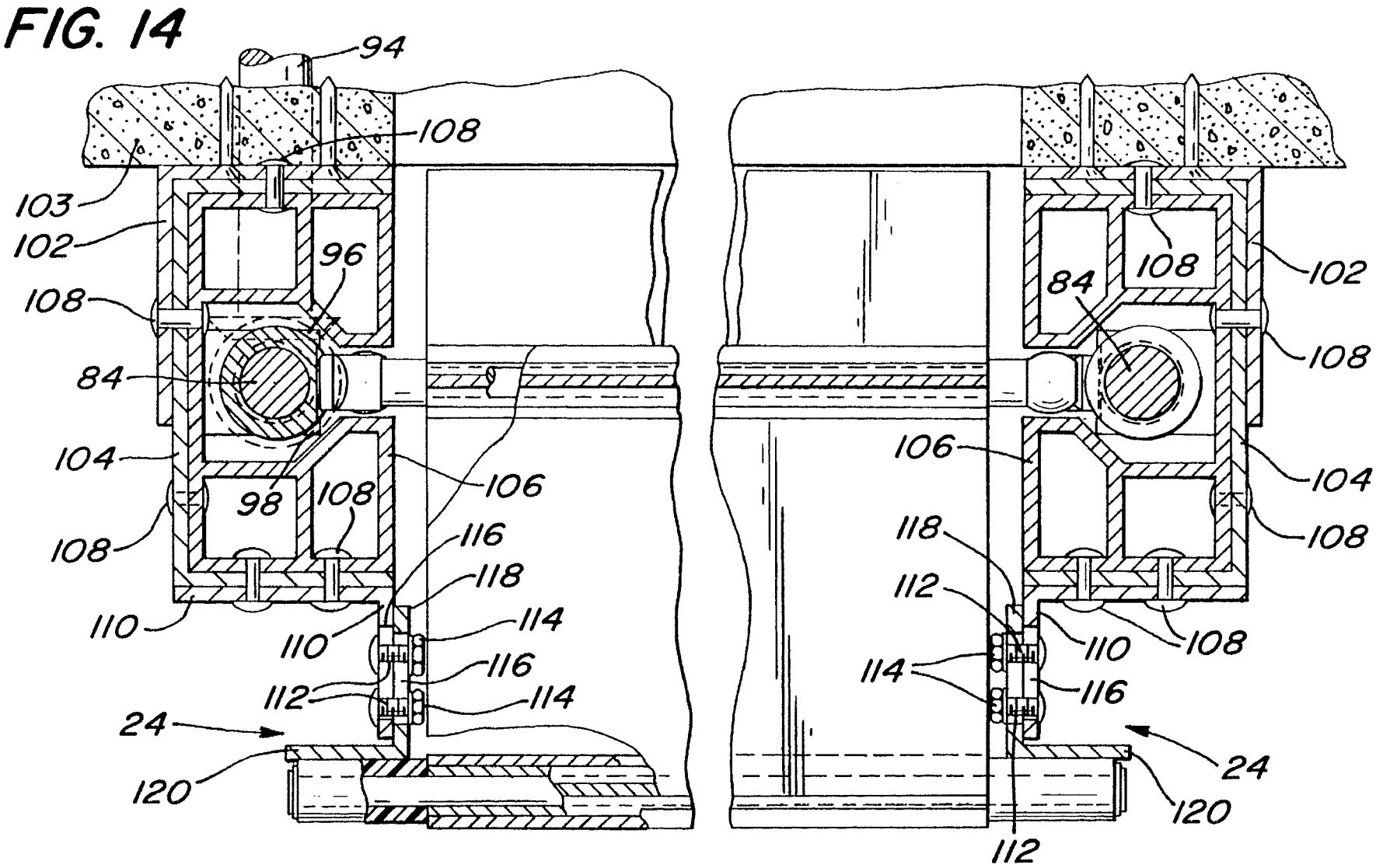
FIG. 14 is a sectional view of the shutter taken along the line 14—14 of FIG. 11.

The adjustment mechanism for changing the angles between the blades is similar to the adjustment mechanism used for changing the angle between the blades in the pulley system alternative. FIG. 14 shows this adjustment system. L-shaped bracket 102 is connected to the wall 103 of the structure to which the shutter is attached. Also shown is the shaft 94 which is connected to the drive gear teeth 96 which are in turn coupled to the driven gear teeth 98 which causes the threaded shaft 86 to rotate.

U-shaped bracket 104 and dual interior bracket 106 are connected to L-bracket 102 by rivets 108. As stated previously, other types of connectors including screws or bolts can be used to connect these brackets. As in the previous alternative, U-shaped bracket 104 has a horizontal segment 110 and adjustable stop 24 has a horizontal segment 118 and a vertical segment 120. The segments 110 and 118 have elongated openings 116 therein. Bolts 112 with nuts 114 are positioned through the elongated openings 116 enabling the vertical segment 120 to be moved closer to or further from the inner pivot 22, to adjust the distance between the inner pivots 22 and the outer pivots 20, which varies the angle between the blades.

FIG. 15 shows the shutter 2 in its retracted position. Since a direct mechanical drive is used in this embodiment, a locking mechanism is not required and angles 121 and 123 are connected to the lower edge of the bottom-most blade 6 to provide spacing between that lower edge of the shutter 2 and the structure. No pressure pad is shown in this embodiment because a portable external motor is used. Of course, if an internal motor is used, a pressure pad or similar type of limit switch can be attached to the bottom of angle 123 to automatically cut off the motor when the shutter 2 is fully extended.

FIGS. 16 and 17 show the connection to the threaded nuts 100 which ride up and down the threaded shafts when the shutter is raised or lowered by the portable motor 28. As can be seen in the figures, the threaded nut 100 has an annular slot 122 with a planar rear wall 124. A dowel pin 126 attaches to the inner pivot 22 of the lowest blade 6 via rod 129. The dowel pin 126 has an indented segment 128 with a rectangularly shaped end 130 which conforms to the size and shape of the annular slot 122. Thus, as can be seen in FIG. 16, when the rectangular end 130 is placed within the annular slot 122, as the threaded shaft 84 rotates, the nut 100 will ride vertically on the shaft 84 which moves the dowel pin 126 and the lowest edge of the bottom-most blade 6 up and down in conformance thereto.

Figure 18:
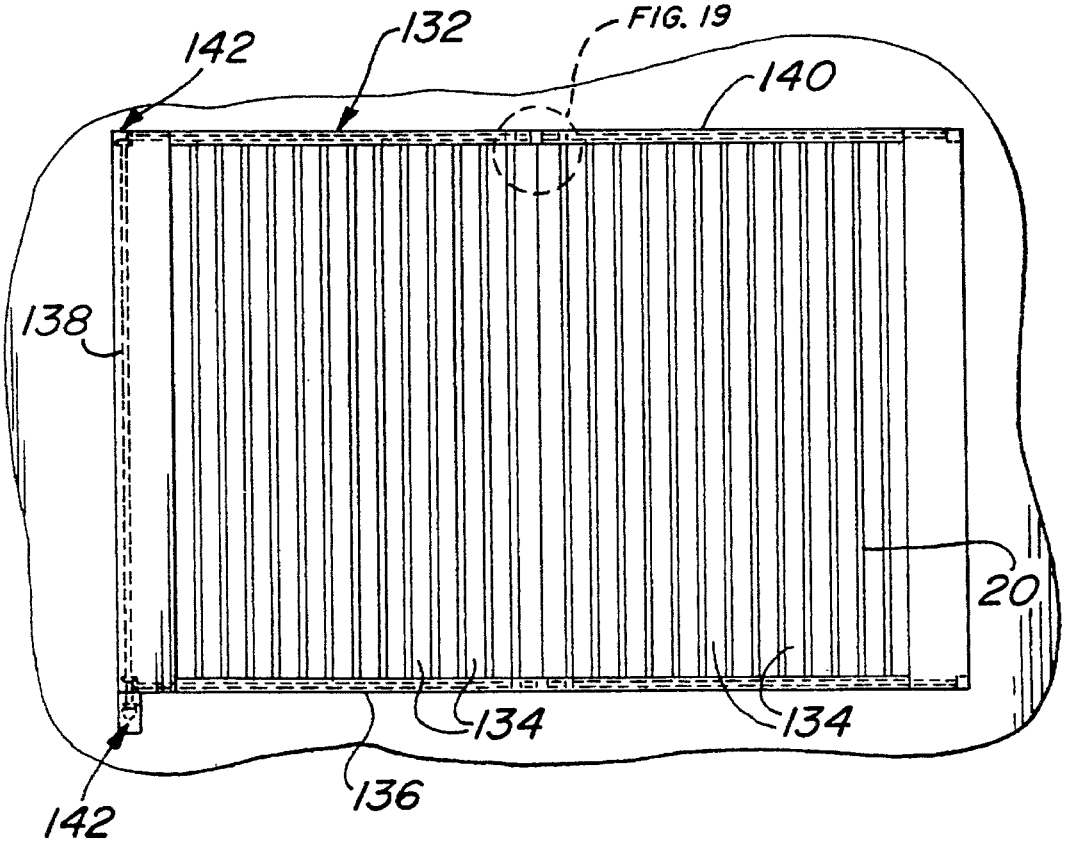
FIG. 18 is an additional embodiment of the invention showing the invention installed in a horizontal shutter with vertically disposed blades.
Figure 19:
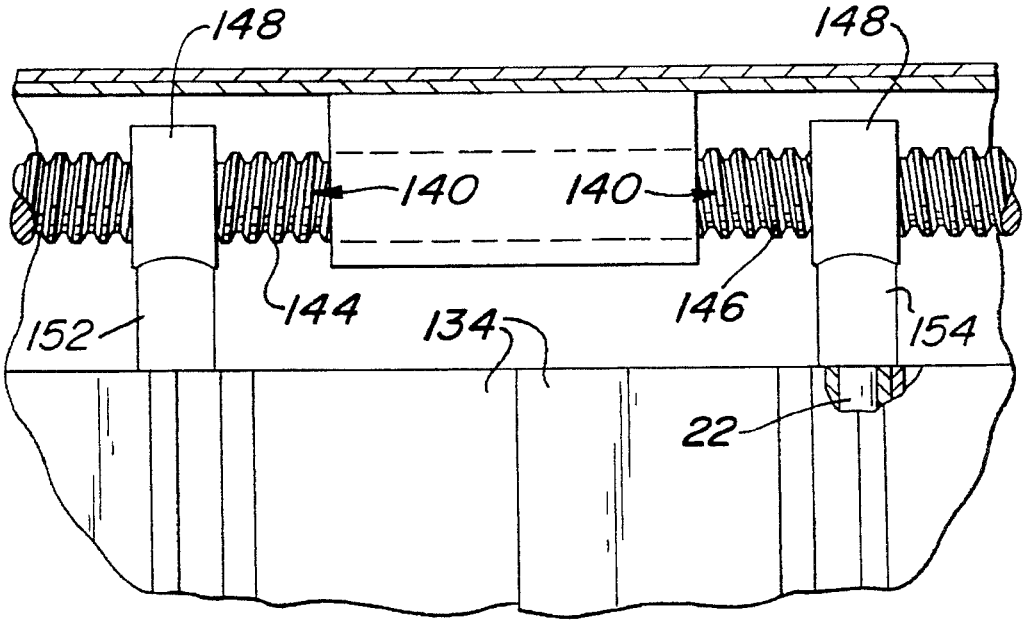
FIG. 19 is an exploded view of the dashed area in FIG. 18 which illustrates the direct mechanical drive mechanism of the horizontal shutter.

Another embodiment of this invention is shown in FIGS. 18 and 19 which illustrate the use of the invention with horizontal shutters. As can be seen in FIG. 18, the horizontal shutter 132 has vertically disposed blades 134 which are interconnected with inner pivots 22 (not shown) and outer pivots 20 as are the blades 6 of the previous embodiments for vertical shutters. The horizontal shutter 132 of this embodiment uses a mechanical drive which is, in effect, rotated 90° as compared to the mechanical drives of the embodiment of FIGS. 11–17. Thus, universal gears 142 are used to directly drive threaded lower horizontal shaft 136. The universal gears 142 drive unthreaded shaft 138 which in turn drives threaded upper shaft 140.

FIG. 19 shows an exploded view of the dashed circular area of FIG. 18. The threaded shaft 140 comprises a portion 144 having a left-handed thread and a portion 146 having the opposite or right-handed thread. Therefore, as the threaded shaft 140 rotates, the nuts 148 travel in opposing directions. The nuts 148 are connect to extensions 152 of the inner joints 154 of the innermost blades 134 of each section of the horizontal shutter 132. A similar arrangement is used with respect to the lower threaded shaft to drive the innermost blades of the shutters in reverse directions. Thus, as the motor drive applied to the system is rotated in one direction, the shutter will tend to open with the nuts 148 traveling apart, and will tend to close with the motor drive rotating in the opposite direction, causing the nuts 148 to move towards each other.

At this point, it should be noted that the blades of the horizontal shutter 132 are interconnected with inner and outer pivots as in the previous two embodiments. An adjustment system which is identical to the adjustment system used for the other embodiments can be applied to the horizontal shutter 132 to change the angle at the junction between the blades 134 in the same manner as with the vertical shutters 2.

A security and hurricane shutter with blades that are interconnected on their longitudinal edges by pivots in accordion fashion has been described. The angle between each blade and its adjoining blade is adjustable to change the strength of the shutter against high winds and impact from flying debris during storms and hurricanes. By decreasing the angle between the blades, more blades are used per linear foot of the shutter, thereby imparting greater strength to the shutter. In the preferred embodiment, the angle between the blades may vary between approximately 45° and approximately 120°.

In its retracted positions, the blades are positioned either horizontally in parallel, and in close proximity with the adjoining blades, resulting in the requirement for enclosure boxes which are considerably smaller than the enclosure boxes required for roll-up types of shutters. Thus, the enclosure box presents a lower profile to high winds. In fact, in many situations, if the well in which the window or door to be protected is placed is deep enough, the enclosure box of this invention may not even protrude from the wall of the structure on which the shutter is installed.

With regard to systems for operating the shutter, i.e., moving the shutter from its extended position to its retracted position and back again, the shutter is extremely flexible and can be provided to use pulleys or direct mechanical systems. In addition, the power source can be either an installed motor, a portable motor which can be used to operate a plurality of shutters, or in the case of smaller shutters, a hand crank can be used. If an installed motor is used, a fall-back hand crank can be used in case of a power failure or in case the installed motor fails. The use of a single portable motor, instead of installed motors, to operate a plurality of shutters, saves considerable equipment and money for multi-shuttered structures. For example, for an installation with eight shutters, the use of a single motor would save 7×$250.00 (cost per motor) or $1,750 (approximately 20% to 25% of the total cost of an $8,000 installation).

Without further elaboration, the foregoing will so fully illustrate our invention, that others may, by applying current or future knowledge, readily adapts the same for use under the various conditions of service.

We claim:

1. A security/hurricane shutter attached to a part of a structure comprising:

(a) a plurality of horizontally disposed blades, each of said blades being rectangular in shape and having a first and second longitudinal edge and a first and second end;

(b) means for pivotably connecting each of said first longitudinal edges to a respective second longitudinal edge of a first adjoining blade and each of said second longitudinal edges to a respective first longitudinal edge of a second adjoining blade, in accordion fashion;

(c) means for adjusting the strength of said shutter to withstand impact from external forces by varying the angle between the plane of each of said plurality of blades and the plane of each of said adjoining blades;

(d) means for raising and lowering said shutter to cover and uncover said part of said structure from a fully raised position to a fully lowered position and from a fully lowered position to a fully raised position;

(e) means for enclosing said blades when said shutter is in the raised position.

2. The shutter of claim 1 wherein each of said plurality of blades comprises a cylindrically shaped socket connected to said first longitudinal edge of each of said blades and a rod connected to said second longitudinal edge of each of said blades.

3. The shutter of claim 2 wherein said means for pivotably connecting each of said plurality of blades to immediately adjoining blades comprises a first joint at said first longitudinal edge, and a second joint at said second longitudinal edge, each of said joints comprising said rod of each of said blades and said cylindrically shaped socket of an adjoining blade.

4. The shutter of claim 3 wherein each of said first joints comprises a pair of first extensions at each end of said first joints which are positioned within a first vertical channel at said first end of said plurality of blades and within a second vertical channel at said second end of said plurality of blades.

5. The shutter of claim 4 wherein said means for adjusting the strength of said shutter comprises an adjustably set stop which contacts said second joints and along which said second joints are positioned.

6. The shutter of claim 5 wherein said adjustably set stop comprises a bracket connected to said structure, and having an elongated hole and at least one bolt positioned in said elongated hole which allows for movement of said bracket to increase or decrease the distance between said second joints and said first joints.

7. A security/hurricane shutter attached to a part of a structure comprising:

(a) a plurality of horizontally disposed blades, each of said blades being rectangular in shape and having a first and a second longitudinal edge and a first and second end;

(b) means for pivotably connecting each of said first longitudinal edges to a respective second longitudinal edge of an adjoining blade and for connecting each of said second longitudinal edges to a respective first longitudinal edge of a second adjoining blade, in accordion fashion;

(c) means for raising and lowering said shutter from a fully raised position to a fully lower position and from a fully lower position to a fully raised position;

(d) means for aligning said blades into a parallel array when said shutter is in said fully raised position wherein each blade lies in a horizontal plane in close proximity to adjoining blades and the width of said array is approximately equal to the width of said blades; and (e) means for enclosing said blades wherein said shutter is in said fully raised position said enclosure comprising a rectangularly shaped box and wherein said shutter further comprises means for adjusting the strength of said shutter to withstand impact from external fores by varying the angle between the planes of each of said adjoining blades.

8. The shutter of claim 7 wherein each of said plurality of blades comprises a cylindrically shaped socket connected to said first longitudinal edge of each of said blades and a rod connected to said second longitudinal edge of each of said blades.

9. The shutter of claim 8 wherein said means for pivotably connecting each of said plurality of blades to immediately adjoining blades comprises a first joint at said first longitudinal edge, and a second joint at said second longitudinal edge, each of said joints comprising said rod of each of said blades and said cylindrically shaped socket of an adjoining blade.

10. The shutter of claim 9 wherein each of said first joints comprises a pair of first extensions at each end of said first joint which are positioned! within a first vertical channel at said first end of said plurality of blades and within a second vertical channel at said second end of said plurality of blades.

11. The shutter of claim 10 wherein said means for adjusting the strength of said shutter comprises an adjustably set stop which contacts said second joints and along which said second joints are positioned.

12. The shutter of claim 11 wherein said adjustably set stop comprises a bracket connected to said structure, and having an elongated hole and at least one bolt positioned in said elongated hole which allows for movement of said bracket to increase or decrease the distance between said second joints and said first joints.

13. The shutter of claim 7 wherein said means for raising and lowering said shutter comprises a mechanical drive system coupled to said shutter and a power source.

14. The shutter of claim 13 wherein said mechanical drive system comprises a first vertical shaft and a first universal gear, said first universal gear coupling said power source to said first vertical shaft, a horizontal unthreaded shaft and a second universal gear, said second universal gear coupling said first vertical shaft to said horizontal unthreaded shaft, a second vertical shaft and a third universal gear, said third universal gear coupling said horizontal shaft to said second vertical shaft and a means for coupling said mechanical drive system to said shutter blades, and wherein said coupling means comprises threads on said first and second shafts, a pair of threaded nuts each threaded on a respective one of said first and second shafts, said nuts having a slot therein, and a pair of dowels, each of said dowels having one end conforming in shape to, and positioned within each of said slots, means for connecting said dowels to a respective one of said first and second ends of the bottom blade of said shutter so that when said first and second shafts are caused to rotate by said power source, said nuts ride up or down said first and second shafts, depending on the direction of rotation imparted to them by said power source, said bottom blade is raised and lowered.

15. A plurality of shutters, each of said shutters comprising;

(a) a plurality of interconnecting blades;

(b) means for extending and retracting said shutter;

(c) at least one enclosure box for enclosing said blades when said shutter is retracted; and (d) a connection means for connecting a portable electrical motor to operate said means for extending and retracting said blades, wherein each of said interconnecting blades is horizontally disposed, is rectangular in shape, and has a first and second longitudinal edge and a first and second end and wherein each of said plurality of blades comprises means for pivotably interconnecting said blades along their longitudinal edges to adjoining blades in accordion fashion, and wherein each of said shutters comprises means for adjusting and setting the angle between each blade and its adjoining blades when said shutter is extended.

16. The plurality of security/hurricane shutters of claim 15 wherein said extending and retracting means comprises at least one pulley operated by said portable motor.

17. The plurality of security/hurricane shutters of claim 15 wherein said extending and retracting means comprises a direct mechanical system operated by said portable motor, and wherein each of said interconnecting blades is vertically disposed, is rectangular in shape, and has a first and second longitudinal edge and a first and second end, and wherein each of said plurality of blades comprises means for pivotably interconnecting said blades along their longitudinal edges to adjoining blades in accordion fashion, and wherein each of said shutters comprises means for adjusting ad setting the angle between each blade and its adjoining blades when said shutter is extended.

18. A security/hurricane shutter attached to a part of structure comprising:

(a) a plurality of vertically disposed blades, each of said blades being rectangular in shape and having a first and second longitudinal edge and a first and second end;

(b) means for pivotably connecting each of said first longitudinal edges to a respective second longitudinal edge of a first adjoining blade and each of said second longitudinal edges to a respective first longitudinal edge of a second adjoining blade in accordion fashion;

(c) means for adjusting the strength of said shutter to withstand impact from external forces by varying the angle between the plane of each of said plurality of blades and the planes of each of said adjoining blades;

(d) means for opening and closing said shutter to cover and uncover said part of said structure from a fully open position to a fully closed position and from a fully closed position to a fully open position.

19. The shutter of claim 18 wherein each of said plurality of blades comprises a cylindrically shaped socket connected to said first longitudinal edge of each of said blades and a rod connected to said second longitudinal edge of each of said blades.

20. The shutter of claim 19 wherein said means for pivotably connecting each of said plurality of blades to immediately adjoining blades comprises a first joint at said first longitudinal edge, and a second joint at said second longitudinal edge, each of said joints comprising said rod of each of said blades and said cylindrically shaped socket of an adjoining blade.

21. The shutter of claim 20 wherein each of said first joints comprises a pair of first extensions at each end of said first joints which are positioned within a first horizontal channel at said first end of said plurality of blades and within a second horizontal channel at said second end of said plurality of blades.

22. The shutter of claim 21 wherein said means for adjusting the strength of said shutter comprises an adjustably set stop which contacts said second joints and along which said second joints are positioned.

23. The shutter of claim 22 wherein said adjustably set stop comprises a bracket connected to said structure, and having an elongated hole and at least one bolt positioned in said elongated hole which allows for movement of said bracket to increase or decrease the distance between said second joints and said first joints.

* * * * *